United States Patent [19]

Draper et al.

[11] 4,015,888

[45] Apr. 5, 1977

[54] ELECTRICAL DEVICE WITH RETRACTABLE GROUNDING PIN AND INDICATING MEANS

[75] Inventors: Charles W. Draper, Clearwater; Raymond H. Legatti, Belleair, both of Fla.

[73] Assignee: Square D Company, Park Ridge, Ill.

[22] Filed: Nov. 5, 1975

[21] Appl. No.: 629,163

[52] U.S. Cl. ..... 339/14 P; 339/45 M; 339/113 L

[51] Int. Cl.[2] ..... H01R 3/06

[58] Field of Search ..... 339/14 P, 14 R, 45 M, 339/46, 113 R, 113 L, 195 M, 195 R, 195 S, 255 R, 255 A

[56] References Cited

UNITED STATES PATENTS

| | | | |
|---|---|---|---|
| 3,171,183 | 3/1965 | Johnston | 339/255 R |
| 3,754,202 | 8/1973 | Nelson | 339/14 P |
| 3,786,392 | 1/1974 | McDaniel | 339/14 P |
| 3,924,914 | 12/1975 | Banner | 339/14 P |

*Primary Examiner*—Roy Lake
*Assistant Examiner*—DeWalden W. Jones
*Attorney, Agent, or Firm*—Harold J. Rathbun; Carmen B. Patti

[57] ABSTRACT

A portable electrical device has a molded body having a cavity closed by a rear wall. Two conductive prongs project through the rear wall for reception into a phase port and a neutral port, respectively, of an electrical outlet. A retractable grounding pin or prong, when in an extended position, extends outwardly from the rear wall in parallel spaced relationship with the two prongs and is receivable by a ground port of the outlet if there is one. When the device is used with an electrical outlet not having a ground port, the grounding pin retracts within the cavity against a spring bias. An indicating pin is operatively connected to the grounding pin and moves, in response to retracting movement of the grounding pin, to an exposed position within a recess in a front wall of the body to provide a visual indication that the device is not grounded by the grounding pin.

10 Claims, 8 Drawing Figures

ELECTRICAL DEVICE WITH RETRACTABLE GROUNDING PIN AND INDICATING MEANS

SUMMARY OF THE INVENTION

It is sometimes desirable to plug a portable electrical device directly into a conventional electrical outlet or receptacle without the use of an extension cord. Such a device, for example, may contain ground fault detection circuitry, associated circuit interruption means, and means for plugging an extension cord of electrically powered equipment into the device for electrical connection to the prongs of the device so that the device provides ground fault protection to the equipment supplied through the cord.

The electrical device preferably has three plug-in prongs, two of which are for completing neutral and phase connections by reception in neutral and phase ports of a receptacle respectively, and the third of which provides a grounding connection by reception into a grounding port of the receptacle. On some occasions, however, it is desirable to plug the device into an electrical outlet not having a grounding port. Present electrical devices which provide ground fault protection by being plugged into existing electrical outlets are not readily usable with outlets having only a phase port and neutral port. A need therefore exists for a portable electrical ground fault protecting device having a retractable grounding prong or pin which permits the device to be connected to either a two or three port electrical outlet. It is also desirable that there be a means for indicating at an exposed side of the device whether the grounding pin is extended and received by a ground port or retracted within the device.

An improved electrical device in accordance with this invention may be plugged into an electrical outlet having either two or three ports and, if there are three ports, completes connections within all three. The device has a body formed with a cavity closed by a rear wall, and includes a retractable grounding pin which, when in an extended position, extends outwardly from the rear wall. When the electrical device is plugged into a three port outlet, a ground port of the outlet receives the grounding pin. The electrical device may also be plugged into a two port outlet that does not have provision for receiving a grounding pin. As the rear wall of the electrical device is moved near the two port electrical outlet and the phase and neutral prongs of the device enter the phase and neutral ports of the outlet, an outer end face of the grounding pin contacts a cover plate of the outlet, and the pin retracts within the cavity of the device against a spring bias. In the retracted position of the grounding pin, an indicating pin operatively connected to the grounding pin extends outwardly into a recess in a front wall of the device against a spring bias, thereby visually indicating that the grounding pin is not connected within a ground port of the outlet. An alternate connection may then be used to provide adequate grounding of the electrical device.

BRIEF DESCRIPTION OF THE DRAWINGS

Other objects and advantages of the invention will become apparent from the following description wherein reference is made to the accompanying drawings, in which.

DETAILED DESCRIPTION OF THE INVENTION

Figure 1:
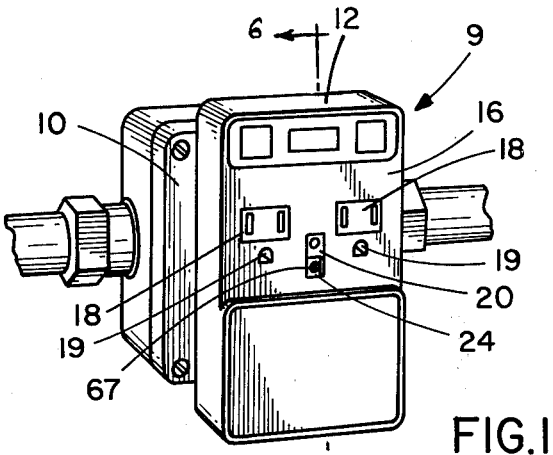
FIG. 1 shows an electrical device embodying the invention electrically connected to, and supported by, a conventional electrical outlet.
Figure 2:
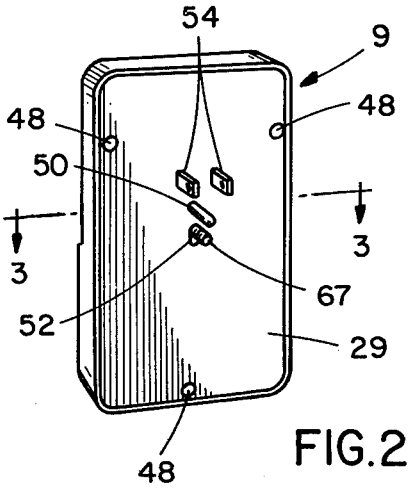
FIG. 2 is a rear perspective view of the electrical device of FIG. 1 showing a retractable grounding pin in an extended position.
Figure 3:
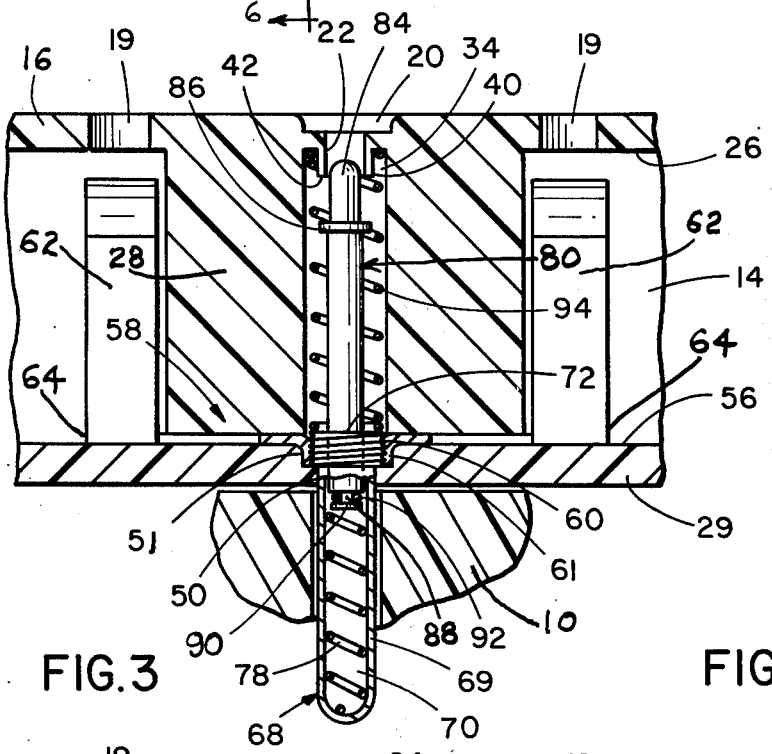
FIG. 3 is a partial sectional view taken generally along the lines 3—3 of FIG. 2.

An electrical device 9 incorporating the invention is shown in FIG. 1 in a mounted position on a conventional electrical outlet 10, and comprised a molded box-like body 12 defining a cavity 14 shown in FIGS. 2 and 3. A forwardly facing or front wall 16 of the body 12 has two groups 18 of three ports. Each group 18 of ports is adapted to receive the phase and neutral prongs and grounding pin of a plug type connector of an extension cord or the like (not shown), the ground prong of the cord being received by a ground port 19 of each group 18.

Formed in the wall 16 between the two groups of ports 18 is a rectangular recess 20. There is a circular opening 22 in the wall 16 within an upper portion of the recess 20 and a rectangular opening 24 in the wall 16 within a lower portion of the recess 20. Extending rearwardly and terminating near a rear wall 29 which closes the cavity 14 is a projecting portion 28 of the wall 16. The projecting portion 28 may have any desired shape depending upon spacing requirements within the cavity 14. The rectangular opening 24 extends through the projecting portion 28 to provide space for a screwdriver as will be described.

A cylindrical opening 32 coaxial with the opening 22 extends into the projection 28 from its rearward end and has a diameter greater than that of the opening 22. A forward end of the opening 32 defines an annular recess 34 and an annular projection 40 containing the opening 22 and having a rearwardly facing annular surface 42.

The rear wall 29 is secured to the body 12 by fastening means such as rivets 48 and has an annular opening 50 coaxial with the openings 22 and 32 and provided with an inner enlarged portion 51. A vertically elongated opening 52 in the rear wall 29 beneath the opening 50 has its upper and lower ends generally coplanar with the upper and lower sides of the opening 24 but is narrower than the opening 24. Two fixed prongs 54 which are receivable in the phase and neutral ports of an electrical outlet, such as the electrical outlet 10 shown in FIG. 1, extend rearwardly from the rear wall 29 and are insulated from each other and connected to the electrical circuitry (not shown) within the cavity 14.

Figure 6:
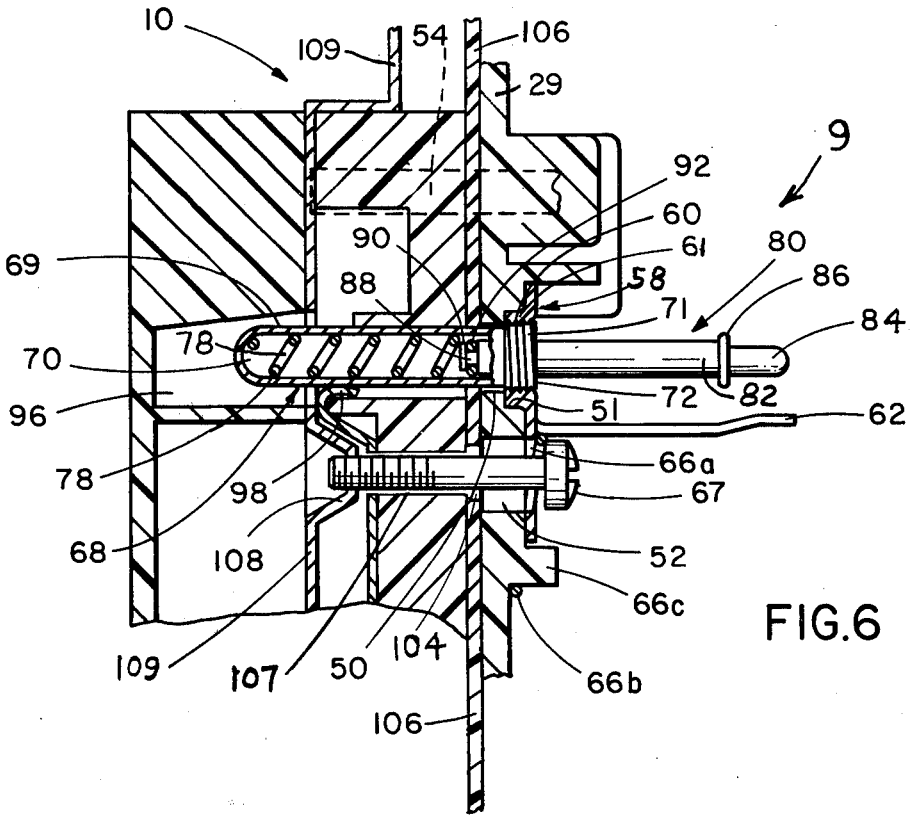
FIG. 6 is a sectional view taken generally along the lines 6—6 of FIG. 1 showing a portion of the device mounted on an electrical outlet having a ground port.
Figure 7:
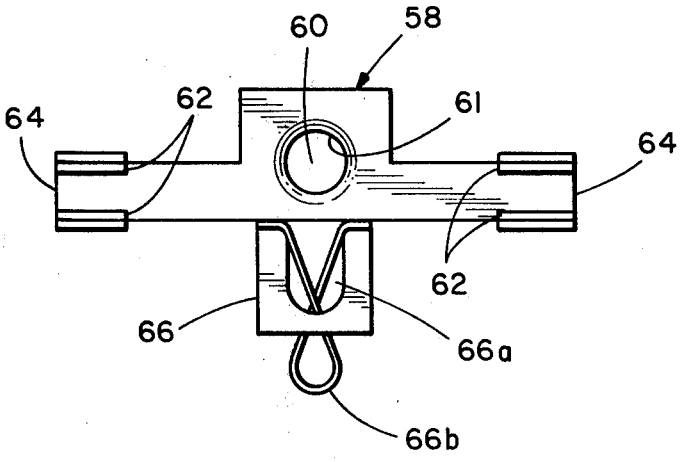
FIG. 7 is a view of a pin clip and a screw retaining means of the device of FIG. 1.
Figure 8:
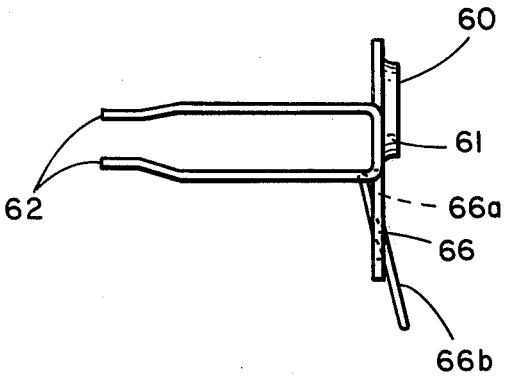
FIG. 8 is a side view of the pin clip and the screw retaining means shown in FIG. 7.

Mounted on an inner side 56 of the rear wall 29 is a grounding pin clip 58 (FIGS. 7 and 8) having a threaded opening 60 in an annular boss 61 which is received in the enlarged portion 51 of the opening 50 in the rear wall 29. A pair of parallel spaced prongs 62 which extend forwardly from opposite end portions 64 of the clip 58 are adapted to receive respective grounding pins inserted through the ground ports 19 of the groups 18 of ports in the forwardly facing wall 16. As best seen in FIGS. 6 and 7, a wing portion 66 of the clip 58 opposite the opening 60 has an opening **66*a* aligned with the slot 52. A screw retaining spring 66*b* has crossed leg portions passing through the opening 66*a* and a loop portion received on a boss 66*c* that extends inwardly of the rear wall 29.**

As best seen in FIGS. 2 and 6, a grounding screw 67 is received in the opening 24 and is held by the retaining spring **66*b*. The screw 67 projects beyond the rear wall 29 through the slot 52 which is elongated in the vertical dimension so that the vertical position of the screw 67 may be varied relative to the fixed prongs 62.**

A grounding pin 68 of the device 9 has an elongated hollow tubular body portion 69 having a cavity 70, an externally threaded portion 71 at an inner end, and an inner end face 72. The closed front wall of the pin 68 is sperical.

Fitting snugly within the cavity 70 is a biasing means such as a helical spring 78 held in place by friction at the closed end of the cavity 70. A plunger 80 receivable in the cavity 70 has a cylindrical body portion 82 and a cylindrical outer body portion 84 on opposite sides of an intermediate flange 86. A narrow stem 88 having an outer end flange 90 extends axially from a rear or inner end face of the body portion 82.

As best seen in FIG. 3, a most forward convolution 92 of the spring 78 fits closely around the stem 88, and the flange 90 prevents the convolution 92 from becoming detached from the plunger 80. The spring 78 opposes movement of the plunger 80 into the cavity 70 and, when the pin 68 is fully extended outwardly from the rear wall 29, as best seen in FIG. 3, the rearward or inner end of the plunger 80 is disposed a short distance within the cavity 70. In the fully extended position of the pin 68, the body portion 84 of the plunger 80 extends a short distance into the opening 22 in the front wall 16, thus moving the plunger 80 from a non-indicating position to an indicating position.

A helical spring 94 is disposed within the cylindrical opening 32 and a forward end of the spring 94 seats within the annular recess 34 while a rearward or inner end of the spring 94 abuts the forwardly facing or inner end face 72 of the grounding pin 68 The spring 94 opposes movement of the pin 68 inwardly into the opening 32.

The springs 78 and 94, the flange 86 and the surface 42 provide a lost motion connection between the pin 68 and the plunger 80 so that initial movement of the pin 68 from its fully extended position toward its retracted position results in immediate movement of the plunger 80 to its indicating position where it remains as the pin 68 continues to move to its fully retracted position. Conversely, movement of the pin 68 from its fully retracted position toward its fully extended position results in delayed movement of the plunger 80 from its indicating to is non-indicating position.

When the electrical device 9 is to be connected to a three port receptacle, the grounding pin 68 is first secured in its fully extended position. This is accomplished by rotating the pin 68 to thread the base portion 71 into the threaded opening 60 of the pin clip 58. This assures that the pin 68 will be able to penetrate into a grounding port 96 (FIG. 6) of the electrical outlet 10 and provide grounding, through a resilient ground member 98 located in the port 96. At the same time, the fixed prongs 54 are received in to an adjacent pair or phase and neutral ports of the electrical outlet.

A more secure or semi-permanent connection between the electrical device 9 and the electrical outlet is sometimes desired. This may be accomplished by first removing a mounting screw (not shown) which normally passes through a centrally located aperture 104 in a cover plate 106 and is threaded in the electrical outlet. The screw 67 is then inserted through the opening 24 with its threaded portion extending through the opening **66*a* in engagement with the spring 66*b*, and through the elongated slot 52 in the rear wall 29. The threaded portion then is inserted through the aperture 104 in the cover plate 106 and an opening 107 in the receptacle 10. A screwdriver (not shown) is then used to thread the screw 67 into a boss 108 in a grounding plate 109 of the receptacle as best seen in FIG. 6. Such an arrangement gives physical security to the device when one or two electrical plugs (not shown) are connected at the groups of ports 18. In this situation, the ground connection made by the screw 67 is not necessary because the pin 68** provides a grounding connection.

If the cover plate 106 is metal, it is desirable to replace it with a similar cover plate of insulating material before mounting the device 9.

Figure 4:
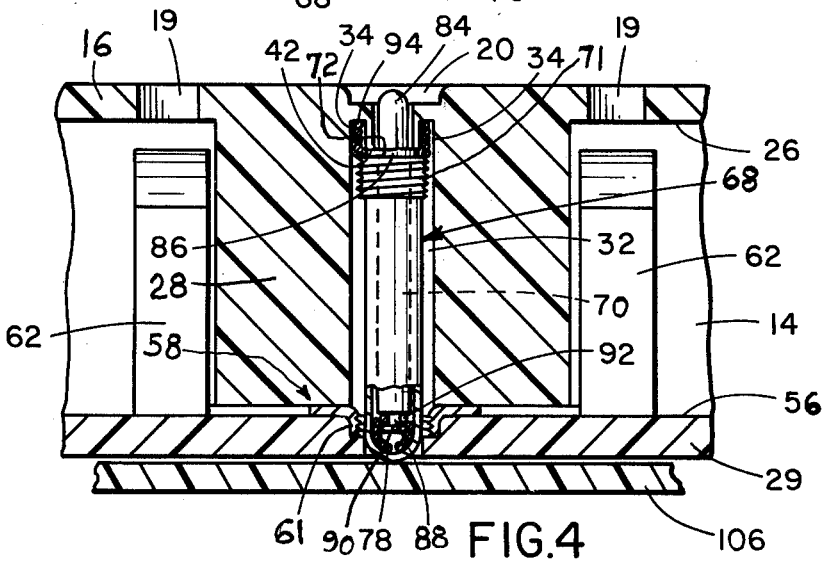
FIG. 4 is a view similar to FIG. 3 showing the grounding pin in a retracted position and an indicating pin in an exposed position.
Figure 5:
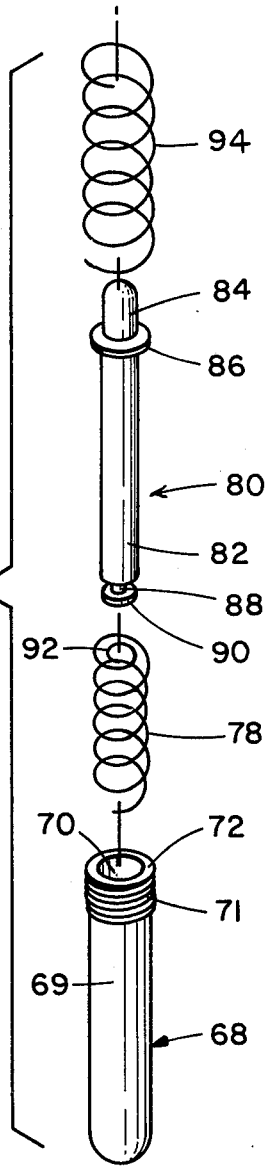
FIG. 5 is an exploded view of the grounding and indicating pins and associated biasing springs.

When the electrical device 9 is to be connected to a two port outlet, the grounding pin 68 is first placed in an unlocked position by unthreading the base portion 71 from the threaded opening 60. The mounting screw that holds the cover plate 106 over the electrical outlet is then removed, and the electrical device 9 is then placed against the outlet. The fixed prongs 54 are inserted into a pair of the adjacent phase and neutral ports in the outlet, and, as this occurs, the closed frontal end of the grounding pin 68 abuts the cover plate 106 and the pin 68 retracts within the cylindrical opening 32 against the bias of the spring 94. At the same time, the plunger 80 moves forwardly within the opening 32, and the cylindrical body portion 84 of the plunger 80 moves outwardly of the opening 22 and into the recess 20 in the forwardly facing wall 16 until the flange 86 abuts the end face 42 of the annular portion 40, thus stopping movement of the plunger 80 within the opening 32. As the grounding pin 68 continues to retract within the cylindrical opening 32, the rear end portion of the plunger 80 moves into the cavity 70 of the pin 68 against the bias of the spring 78. In the fully retracted position, the springs 78 and 94 are compressed as in FIG. 4.

The extension of the body portion 84 into the recess 20 provides a visual indication that the grounding pin 68 is not received in a grounding port in the electrical outlet. In the extended position of the plunger 80, its outer end face is substantially coplanar with the outer surface of the wall 16 so that the body portion 84 will be contained within the recess 20 where it is protected from damage by inadvertent contact, but still readily visible.

To provide a ground connection, the grounding screw 67 must be installed, as described above and as best seen in FIG. 6, so that the electrical device 10 is adequately grounded and physically secured in place.

We claim:

1. An electrical device selectively pluggable into electrical outlets with either two or three ports and in which two of the ports are connected to power lines, the electrical device comprising a body having a cavity closed by front and rear walls, two prongs operatively connected within the cavity and projecting from the body through the rear wall for reception respectively in the ports of an outlet which are connected to power lines, a grounding pin operatively connected within the cavity and mounted for movement between an extended position wherein the pin extends from the body through an opening in the rear wall for reception in a third port of the outlet and a retracted position wherein the pin is retracted within the cavity, means for locking the grounding pin in the extended position, and a plunger mounted for reciprocal movement between a position wherein an outer end portion of the plunger is readily visible at an opening in the front wall to a position where it is not readily visible at the opening in the front wall for indicating whether the grounding pin is in its extended or retracted position.

2. An electrical device as in claim 1 wherein, when the outer end portion of the plunger is readily visible, it extends outwardly from the opening in the front wall and, when the outer end portion of the plunger is not readily visible, it is entirely within the opening in the front wall.

3. An electrical device as in claim 2 wherein the movement of the grounding pin between its extended and retracted positions is a reciprocal movement along its longitudnal axis, and the plunger is coaxially aligned with the grounding pin, connected thereto, and mounted for reciprocal movement along its longitudinal axis as a result of reciprocal movement of the grounding pin.

4. An electrical device as in claim 3 wherein the grounding pin and plunger are interconnected by a lost-motion means for causing the plunger to indicate that the grounding pin is extended only when the grounding pin is substantially fully extended.

5. An electrical device as claimed in claim 4 wherein the grounding pin is tubular having an elongated hollow portion, the plunger is slidably receivable within the hollow portion of the pin, and the lost motion means comprises a first biasing means that opposes movement of the plunger into the hollow portion of the pin, a second biasing means that opposes movement of the pin toward its retracted position, and a stop means for preventing longitudinal movement of the plunger relative to the pin after the pin is retracted a short distance within the cavity.

6. An electrical device as claimed in claim 5 wherein the first biasing means is a helical spring having one end secured within the hollow portion of the grounding pin and the other end secured to an inner end of the plunger thereby preventing displacement of the plunger from the pin and assuring that the outer end portion of the plunger is readily visible at the opening in the front wall whenever the pin is not in its fully extended position.

7. An electrical device as claimed in claim 5 wherein the second biasing means is a helical spring coaxial with the pin and plunger and having one end abutting an inner end face of the pin and the other end abutting the inner surface of the front wall about the opening therein.

8. An electrical device selectively pluggable into electrical outlets with either two or three ports and in which two of the ports are connected to power lines the electrical device comprising a body having a cavity closed by front and rear walls, two prongs operatively connected within the cavity and projecting from the body through the rear wall for reception respectively in the ports of an outlet which are connected to power lines, a grounding pin operatively connected within the cavity and mounted for movement between an extended position wherein the pin extends from the body through an opening in the rear wall for reception in a third port of the outlet and a retracted position wherein the pin is retracted within the cavity, means for locking the grounding pin in the extended position comprising a threaded portion on an inner end of the pin and a complementary threaded portion affixed to the rear wall, and an indicating means operatively connected to the grounding pin for indicating whether the grounding pin is in its extended or retracted position.

9. An electrical device as claimed in claim 8 wherein a clip is mounted at an inner surface of the rear wall and the clip has a threaded opening coaxial with the opening in the rear wall constituting the threaded portion.

10. An electrical device as claimed in claim 9 wherein means is provided for fastening the device to a centrally located threaded aperture in an electrical outlet, said fastening means comprising a wing portion of the clip, the wing portion having a first elongated slot radially aligned with the threaded opening, a screw retaining means retained in the first slot, an elongated slot through the rear wall and aligned with the first slot, an opening in the front wall aligned with the first and second slots, and a screw having its threaded shank disposed within the opening in the front wall and the slots for reception is the threaded aperture in the electrical outlet.

* * * * *